US009860665B2

(12) United States Patent
Lim et al.

(10) Patent No.: US 9,860,665 B2
(45) Date of Patent: Jan. 2, 2018

(54) METHOD AND APPARATUS FOR PROCESSING AUDIO SIGNAL BASED ON SPEAKER LOCATION INFORMATION

(71) Applicant: SAMSUNG ELECTRONICS CO., LTD., Suwon-si (KR)

(72) Inventors: Dong-hyun Lim, Seoul (KR); Yoon-jae Lee, Seoul (KR); Hae-kwang Park, Suwon-si (KR); Seung-kwan Yoo, Hwaseong-si (KR); Eun-mi Oh, Seoul (KR); Jae-youn Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/240,416

(22) Filed: Aug. 18, 2016

(65) Prior Publication Data

US 2017/0055098 A1 Feb. 23, 2017

(30) Foreign Application Priority Data

Aug. 20, 2015 (KR) ..... 10-2015-0117342

(51) Int. Cl.

| | |
|---|---|
| ***H04S 7/00*** | (2006.01) |
| ***H04R 3/04*** | (2006.01) |
| ***H04R 5/02*** | (2006.01) |

(52) U.S. Cl.

CPC ..... *H04S 7/303* (2013.01); *H04R 3/04* (2013.01); *H04R 5/02* (2013.01); *H04R 2205/024* (2013.01); *H04R 2420/07* (2013.01); *H04R 2430/03* (2013.01); *H04S 7/307* (2013.01); *H04S 2400/13* (2013.01)

(58) Field of Classification Search

CPC ..... H04S 7/303; H04S 7/307; H04S 2400/13; H04R 3/04; H04R 5/02; H04R 2205/024; H04R 2420/07; H04R 2430/03

See application file for complete search history.

(56) References Cited

U.S. PATENT DOCUMENTS

| | | | |
|---|---|---|---|
| 5,930,373 | A | 7/1999 | Shashoua et al. |
| 7,848,531 | B1 | 12/2010 | Vickers et al. |
| 8,150,067 | B2 | 4/2012 | Ohkuri et al. |
| 8,238,576 | B2 | 8/2012 | Cooper et al. |

(Continued)

FOREIGN PATENT DOCUMENTS

| | | |
|---|---|---|
| EP | 0972426 B1 | 1/2003 |
| EP | 2522156 B1 | 8/2014 |

(Continued)

OTHER PUBLICATIONS

English machine translation of JP2006-101248A (Iida, Sound Field Compensation Device, published Apr. 2006).*

(Continued)

*Primary Examiner* — Mark Fischer

(74) *Attorney, Agent, or Firm* — Sughrue Mion, PLLC

(57) ABSTRACT

A method of processing an audio signal is provided. The method includes acquiring location information and performance information of a speaker configured to output an audio signal, selecting a frequency band based on the location information, determining a section to be strengthened from the selected frequency band with respect to the audio signal based on the performance information, and applying a gain value to the determined section.

16 Claims, 12 Drawing Sheets

(56) References Cited

U.S. PATENT DOCUMENTS

| | | | | |
|---|---|---|---|---|
| 8,280,076 | B2 | 10/2012 | Devantier et al. | |
| 8,331,570 | B2 | 12/2012 | Kasargod et al. | |
| 8,750,538 | B2 | 6/2014 | Avendano et al. | |
| 8,989,404 | B2 | 3/2015 | De Poortere | |
| 2013/0163784 | A1 | 6/2013 | Tracey et al. | |
| 2014/0044288 | A1 | 2/2014 | Kato et al. | |
| 2014/0270282 | A1* | 9/2014 | Tammi | H04R 5/02 381/300 |

FOREIGN PATENT DOCUMENTS

| | | | |
|---|---|---|---|
| JP | 2006101248 | A | 4/2006 |
| JP | 2007272843 | A | 10/2007 |

OTHER PUBLICATIONS

Daniel Ben-Tzur and Martin Colloms, "The Effect of the MaxxBass Psychoacoustic Bass Enhancement System on Loudspeaker Design", May 1, 1999, Audio Engineering Society, Total 10 pages.

* cited by examiner

METHOD AND APPARATUS FOR PROCESSING AUDIO SIGNAL BASED ON SPEAKER LOCATION INFORMATION

CROSS-REFERENCE TO RELATED APPLICATION

This application claims priority from Korean Patent Application No. 10-2015-0117342, filed on Aug. 20, 2015, in the Korean Intellectual Property Office, the disclosure of which is incorporated herein in its entirety by reference.

BACKGROUND

1. Field

Apparatuses and methods consistent with exemplary embodiments relate to processing an audio signal based on location information of a speaker which outputs the audio signal.

2. Description of the Related Art

Audio systems may output audio signals through multiple channels such as 5.1 channels, 2.1 channels, and stereo. Audio signals may be processed or output on the basis of locations of speakers which output the audio signals.

However, the locations of the speakers may change from their original locations which the audio signals were processed with reference to. In other words, the locations of the speakers may not be fixed according to an ambient environment in which the speakers are installed due to the mobility of the speakers. Accordingly, when the locations of the speakers change, an audio system may have a problem providing high-quality audio signals to listeners because the audio signals are processed without considering the current locations of the speakers.

SUMMARY

One or more exemplary embodiments provide a method and apparatus for adaptively processing an audio signal according to speaker information, in particular, for processing an audio signal based on location information of a speaker that outputs the audio signal.

According to an aspect of an exemplary embodiment, a method of processing an audio signal includes acquiring location information and performance information of a speaker configured to output an audio signal; selecting a frequency band based on the location information; determining a section to be strengthened from the chosen frequency band with respect to the audio signal based on the performance information; and applying a gain value to the determined section.

The selecting of the frequency band may include determining a central axis based on a location of a listener; and selecting the frequency band based on a linear distance between the speaker and the central axis.

The applying of the gain value may include determining a central axis based on a location of a listener; and determining the gain value based on a distance between the speaker and the central axis.

The method may further include: determining a parameter based on the location information; and processing the audio signal using the determined parameter. The parameter may include at least one of a gain for correcting a sound level of a sound image of the audio signal based on the location information of the speaker and a delay time for correcting a phase difference of the sound image of the audio signal based on the location information of the speaker.

When a plurality of speakers are provided, the parameter may further include a panning gain for correcting a direction of a sound image of the audio signal.

The method may further include obtaining an energy variation of the audio signal between frames in a time domain; determining a gain value of a frame according to the energy variation; and applying the determined gain value to a portion of the audio signal corresponding to the frame.

The method may further include: detecting a section in which masking has occurred based on the section to which the gain value is applied; and applying the gain value to the detected section of the audio signal so that a portion of the audio signal corresponding to the detected section has a value greater than or equal to a masking threshold.

The applying of the gain value may include: extracting a non-mono signal from the audio signal; determining the gain value based on a maximum value of the non-mono signal; and applying the determined gain value to the audio signal.

According to an aspect of another exemplary embodiment, an audio signal processing apparatus may include a receiver configured to acquire location information and performance information of a speaker configured to output an audio signal; a controller configured to select a frequency band based on the location information, determine a section to be strengthened from the selected frequency band with respect to the audio signal based on the performance information, and apply a gain value to the determined section; and an output unit configured to output the audio signal processed by the controller.

BRIEF DESCRIPTION OF THE DRAWINGS

The above and/or other aspects will become apparent and more readily appreciated from the following description of exemplary embodiments, taken in conjunction with the accompanying drawings in which.

DETAILED DESCRIPTION

Figure 1:
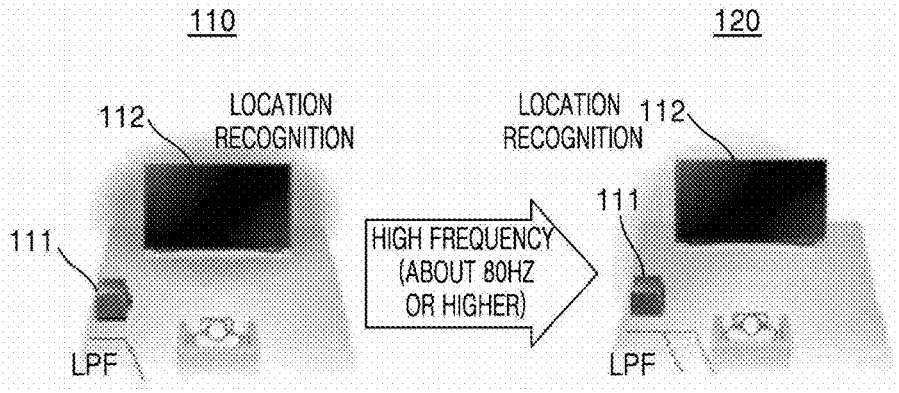
FIG. 1 is a view showing an example of an audio system according to an exemplary embodiment.

Reference will now be made in detail to embodiments, examples of which are illustrated in the accompanying drawings. However, detailed descriptions related to well-known functions or configurations will be omitted in order not to unnecessarily obscure the subject matter of the present invention. In addition, it should be noted that like reference numerals denote like elements throughout the specification and drawings. As used herein, the term "and/or" includes any and all combinations of one or more of the associated listed items. Expressions such as "at least one of," when preceding a list of elements, modify the entire list of elements and do not modify the individual elements of the list.

The terms or words used in the specification and claims are not to be construed as being limited to typical or dictionary meanings, but should be construed as having a meaning and concept corresponding to the technical idea of the present invention on the basis of the principle that an inventor can appropriately define the concept of the term for describing his or her invention in the best method. Accordingly, the configurations illustrated in embodiments and drawings described in the specification do not represent the technical idea of the present invention but are just exemplary embodiments. Thus, it should be understood that there may be various equivalents and modifications that can be replaced at the time of filing.

Likewise, some elements in the accompanying drawings are exaggerated or omitted, and each element is not necessarily to scale. Accordingly, the present invention is not limited to relative sizes or intervals illustrated in the accompanying drawings.

Furthermore, when one part is referred to as "comprising (or including or having)" other elements, it should be understood that it can comprise (or include or have) only those elements or other elements as well as those elements unless specifically described otherwise. In this disclosure, when one part (or element, device, etc.) is referred to as being "connected" to another part (or element, device, etc.), it should be understood that the former can be "directly connected" to the latter or "electrically connected" to the latter via an intervening part (or element, device, etc.).

The singular forms 'a,' 'an,' and 'the' include plural reference unless context clearly dictates otherwise. In the present specification, it should be understood that terms such as "including," "having," and "comprising" are intended to indicate the existence of features, numbers, steps, actions, components, parts, or combinations thereof disclosed in the specification, and are not intended to preclude the possibility that one or more other features, numbers, steps, actions, components, parts, or combinations thereof may exist or may be added. The word "exemplary" is used herein to mean "serving as an example or illustration." Any aspect or design described herein as "exemplary" is not necessarily to be construed as preferred or advantageous over other aspects or designs.

The term "unit" used herein denotes software or a hardware component such as a field programmable gate array (FPGA) or an application specific integrated circuit (ASIC), and the "unit" may perform any role. However, a "unit" is not limited to software or hardware. A "unit" may be configured to be in an addressable storage medium or to execute one or more processors. Accordingly, as an example, a "unit" may include elements *continue* such as software elements, object-oriented software elements, class elements, and task elements, processes, functions, attributes, procedures, sub-routines, segments of program codes, drivers, firmware, micro-codes, circuits, data, database, data structures, tables, arrays, and variables. Furthermore, functions provided in elements and "units" may be combined as a smaller number of elements and "units" or further divided into additional elements and "units."

In addition, in this disclosure, an audio object refers to each sound component included in an audio signal. Various audio objects may be included in one audio signal. For example, an audio signal generated by recording a live orchestra performance includes multiple audio objects generated from multiple instruments such as a guitar, a violin, an oboe, etc.

In addition, in this disclosure, a sound image refers to a location from which a listener feels a sound source is generated. An actual sound is output from a speaker, but a point at which each sound source is virtually focused is referred to as the sound image. The size and location of a sound image may vary depending on the speaker which outputs the sound. When the locations of sounds from sound sources are obvious and the sounds from the sound sources are separately and clearly audible to listeners, the sound image localization may be considered excellent. There may be a sound image as a place from which a listener may feel a sound source of each audio object is generated.

Hereinafter, exemplary embodiments of the present disclosure will be described in detail with reference to the accompanying drawings such that those skilled in the art may easily carry out the embodiments. The present invention may, however, be embodied in many different forms and are not to be construed as being limited to the embodiments set forth herein. In the accompanying drawings, portions irrelevant to a description of the exemplary embodiments will be omitted for clarity. Moreover, like reference numerals refer to like elements throughout.

Hereinafter, exemplary embodiments of the present invention will be described with reference to the accompanying drawings.

FIG. 1 is a view showing an example of an audio system according to an exemplary embodiment.

As shown in FIG. 1, a speaker 111 that outputs an audio signal may be located around a listener. The speaker 111 may output an audio signal that is processed by an audio signal processing apparatus. When the speaker is a device with good mobility such as a wireless speaker, a location of the speaker 111 may change in real time. An audio signal processing apparatus according to an embodiment may sense a change in location of the speaker 111 and may process an audio signal on the basis of information regarding the changed location. The audio signal processing apparatus may adaptively process an audio signal according to the change in location of the speaker 111.

Referring to reference number 110 of FIG. 1, the speaker 111 may be connected to a multimedia device 112 to operate as a subwoofer. The subwoofer may output low-frequency band audio signals that are difficult to output through the multimedia device 112 or other speakers. The low-frequency band audio signal is strengthened and output by the subwoofer. Thus, a cubic effect, a sense of volume, a sense of weight, and a majestic feeling of the audio signal may be more effectively represented. On a condition that the speaker 111 operates as a subwoofer, when a sense of direction of the low-frequency band audio signal that is output from the speaker 111 is not properly recognized, the above-described cubic effect, sense of volume, sense of weight, and majestic feeling may be more effectively recognized. As the frequency of an output audio signal decreases, the sense of direction is not properly recognized. However, the frequency bandwidth of the audio signal that is strengthened and output from the speaker 111 narrows, and thus it may be difficult to properly achieve an effect caused by the strengthening and outputting of a low-frequency band audio signal.

For example, in a room or a living room having a typical size, an output direction of an audio signal of 80 Hz or less with respect to the location of the speaker 111 is difficult to recognize by a listener. However, when the audio signal of 80 Hz or less is strengthened and output from the speaker 111, a sound effect caused by the strengthening and outputting of the low-frequency band audio signal may be properly achieved.

Referring to reference number 120, an audio signal of a frequency band higher than that of reference number 110 may be output from the speaker 111. A sense of direction of an audio signal output from the speaker 111 in reference number 120 may be more easily recognized by a listener than that of an audio signal output from the speaker 111 in reference number 110. As the speaker 111 is located closer to the front of a listening location, the audio signal is output closer to the front of the listener. Thus, the sense of direction felt by the listener may be reduced. In addition, when the speaker 111 is located to the left or right of the listening location, the direction of the output signal output from the speaker 111 may be strongly recognized according to the location of the speaker 111.

Accordingly, the audio signal processing apparatus according to an exemplary embodiment may select a frequency band at which an audio signal is intended to be amplified, according to the location information of the speaker 111. For example, the frequency band of the audio signal may be selected on the basis of a linear distance between the speaker 111 and a central axis determined on the basis of the listening location. The apparatus may determine a section corresponding to the selected frequency band of the audio signal and may apply a gain value to the section. A sound effect caused by the strengthening and outputting of a low-frequency band audio signal may be optimized by applying the gain value to the section of the audio signal determined according to the location information of the speaker 111 and then outputting the audio signal.

The location of the listener may be determined on the basis of a location of a mobile device (e.g., a smartphone) of the listener. However, embodiments of the present disclosure are not limited thereto. The location of the listener may be determined on the basis of various types of terminal devices, for example, a wearable device, a personal digital assistant (PDA) terminal, etc.

Figure 2:
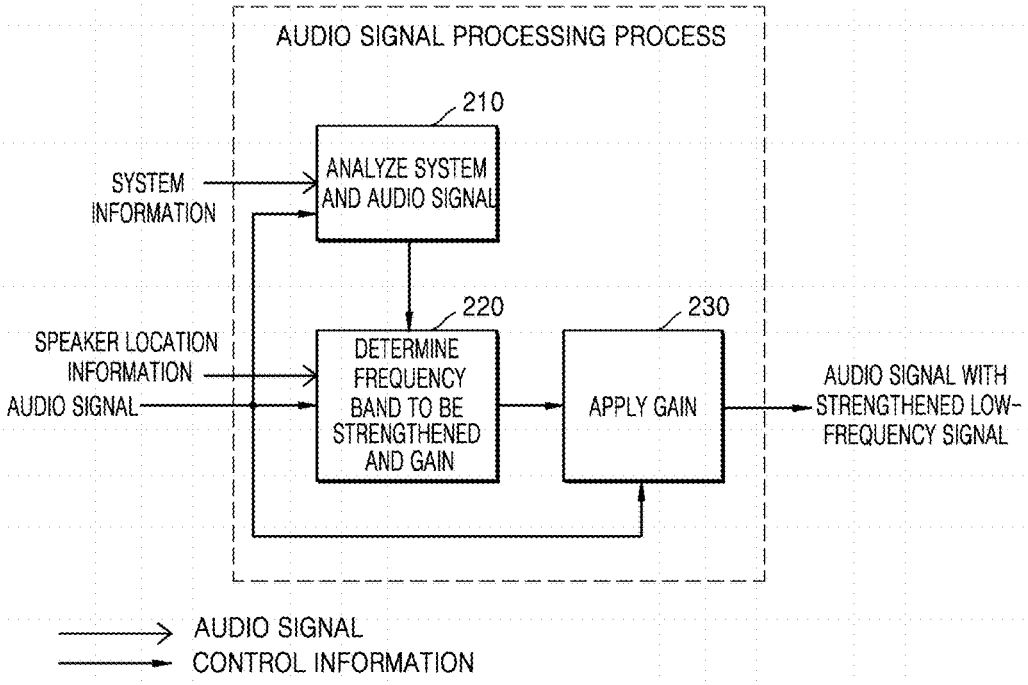
FIG. 2 is a view showing an a process of processing an audio signal according to an exemplary embodiment.

FIG. 2 is a view showing an example of a process of processing an audio signal according to an exemplary embodiment. The process of FIG. 2 may be implemented by the above-described audio signal processing apparatus.

Referring to FIG. 2, an audio signal processing process may include a process 210 of analyzing a system and an audio signal, a process 220 of determining a frequency band to be strengthened and a gain, and a process 230 of applying the gain.

In the process 210, the apparatus may analyze a system which outputs an audio signal and configuration information of the audio signal. For example, the apparatus may acquire location information and performance information of speakers which output audio signals. The performance information of the speakers may include information regarding a frequency band and a magnitude of an audio signal that may be output by each of the speakers. The configuration information of the audio signal may include information regarding a frequency band and a magnitude of the audio signal.

The apparatus may detect the frequency band of an audio signal that is not output by the speaker on the basis of the performance information of the speaker, and may amplify an audio signal of another frequency band on the basis of the audio signal of the detected frequency band. For example, the apparatus may amplify the audio signal of the other frequency band by the magnitude of the audio signal of the frequency band that is not output by the speaker, and may output the amplified audio signal.

In process 220, the apparatus may determine a frequency band that is to be strengthened and may determine a gain to be applied to an audio signal corresponding to the determined frequency band. The apparatus may select the frequency band to be amplified on the basis of location information of the speakers that are acquired in process 210 of analyzing a system and an audios signal. In addition, the apparatus may determine a gain on the basis of speaker location information or acquire a predetermined gain value.

For example, the apparatus may select a frequency band and acquire a gain value to be applied to the selected frequency band on the basis of the speaker location information. The apparatus may select a frequency band of the audio signal to be amplified so that a low-frequency band audio signal may be optimally output.

In addition, the apparatus may acquire a gain value to be applied to the audio signal output from the speaker on the basis of the speaker location information without selecting the frequency band. The apparatus may acquire the gain value on the basis of the speaker location information so that a sound image of the audio signal may be localized to a reference location.

In process 230, the apparatus may apply the gain determined in process 220 to the audio signal. In addition, after applying the gain determined in process 220 to the audio signal, the apparatus may analyze the audio signal to which the gain is applied and correct the audio signal according to a result of the analysis.

For example, the apparatus may acquire an energy variation of the audio signal in a time domain and may further determine a gain to be applied to the audio signal on the basis of the energy variation of the audio signal. The apparatus may correct the audio signal to strengthen a sense of punch (power) by applying the gain determined on the basis of the energy variation to the audio signal.

In addition, the apparatus may extract a non-mono audio signal from the audio signal and may determine a gain to be applied to the audio signal on the basis of the non-mono audio signal. The non-mono signal is a signal obtained by removing a mono signal from a stereo signal and may include sounds such as a background sound, a sound effect, or the like except for a voice. When the low-frequency band audio signal has a smaller magnitude than the background sound or the sound effect included in the non-mono signal, the apparatus may amplify the low-frequency band audio signal by the magnitude of the non-mono signal to strengthen the background sound or the sound effect in the low frequency band. In addition, because the non-mono signal, which is separated from an original audio signal, has a smaller magnitude than the original audio signal, the possibility of clipping may decrease when the gain is determined on the basis of the magnitude of the non-mono signal.

In addition, the apparatus may compare the magnitude of the low-frequency band audio signal and the magnitude of a high-frequency band audio signal to correct the magnitude of the high-frequency band audio signal. When an audio signal of a specific low-frequency band has a larger magnitude than a high-frequency band audio signal, an audio signal of a specific high-frequency band may be masked by a low-frequency band audio signal by strengthening the low-frequency band signal. When masking occurs, audio signals may be output while an audio signal of a corresponding high-frequency band cannot be properly heard. Accordingly, the apparatus may perform amplification by applying a predetermined gain value to the high-frequency band audio signal so that the high-frequency band audio signal is not masked.

Figure 3:
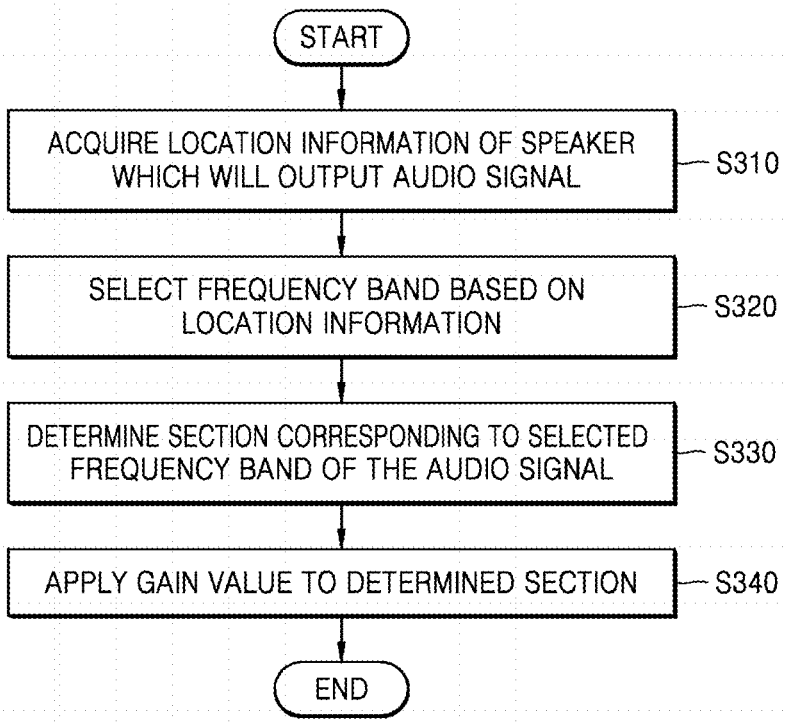
FIG. 3 is a flowchart showing a method of processing an audio signal based on speaker location information according to an exemplary embodiment.

FIG. 3 is a flowchart showing a method of processing an audio signal based on speaker location information according to an exemplary embodiment.

Referring to FIG. 3, in step S310, an audio signal processing apparatus may acquire location information of a speaker which will output an audio signal. For example, the speaker location information may include coordinate information having a listening location as an origin or angle and distance information. When there are a plurality of speakers which will output audio signals, the apparatus may acquire location information of the plurality of speakers.

In step S320, the audio signal processing apparatus may select a frequency band to be amplified on the basis of the location information acquired in step S310. As described above, a sense of direction of a high-frequency band audio signal may be easily recognized. However, when the frequency band to be amplified is narrow, an effect caused by the amplification of a low-frequency band audio signal may not properly occur. Accordingly, the apparatus may select a frequency band in which the effect caused by the amplification of a low-frequency band audio signal may optimally occur according to the speaker location information and may amplify an audio signal of the selected frequency band.

For example, the apparatus may select the frequency band of the audio signal that is intended to be amplified on the basis of a linear distance between the speaker and a central axis determined on the basis of the listening location. As the linear distance between the speaker and the central axis or an angle between the speaker and the center axis increases, a cut-off frequency, which is a criterion for selecting the frequency band, may decrease. The apparatus may select the frequency band on the basis of the cut-off frequency. For example, the apparatus may select a section between a minimum frequency and a cut-off frequency of an amplifiable audio signal as the frequency band of the audio signal that is intended to be amplified.

In step S330, the apparatus may determine a section to be strengthened from the frequency band of the audio signal that is selected in step S320 and may amplify an audio signal of the selected frequency band by applying a gain value to the section determined in step S340. The gain value that is applied in step S340 may be a predetermined value or may be determined on the basis of the audio signal and speaker capability information.

For example, a maximum magnitude of an audio signal for each frequency band may be determined according to the speaker performance information. When the audio signal to which the gain value is applied has a magnitude greater than the maximum magnitude of the audio signal that may be output by the speaker, clipping may occur, thereby reducing sound quality. Accordingly, the apparatus may determine the gain value differently depending on a frequency band of an audio signal to prevent clipping.

In addition, the gain value may be determined on the basis of the speaker location information. As the linear distance between the speaker and the central axis determined on the basis of the listening location increases, it may be determined that the gain value also increases.

Figure 4:
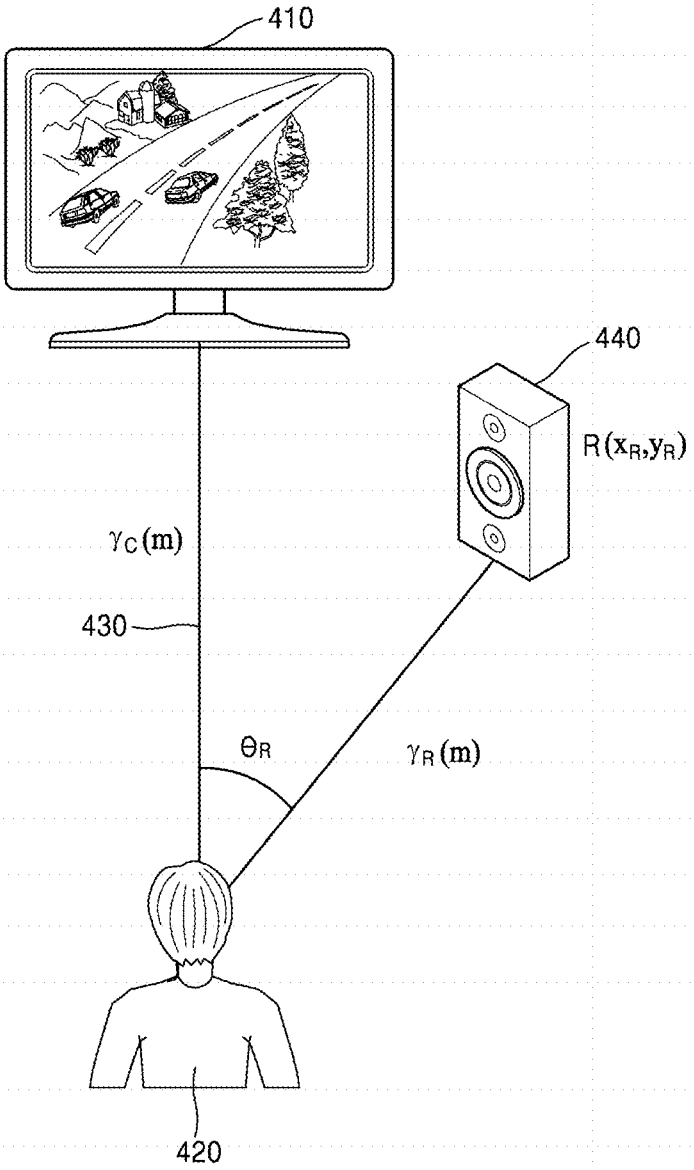
FIG. 4 is a view showing an exemplary placement of a speaker according to an exemplary embodiment.

FIG. 4 is a view showing an example of placement of a speaker according to an exemplary embodiment.

Referring to FIG. 4, location information of a speaker 440 may be acquired with respect to a location of a listener 420. A multimedia device 410 may be located in front of the location of the listener 420. However, the location of the multimedia device 410 shown in FIG. 4 is merely an example, and the multimedia device 410 may be located in another direction.

An audio signal processing apparatus may have a filter function for amplifying a low-frequency band audio signal on the basis of the speaker location information. The apparatus may improve sound quality of the audio signal by using the filter function. The audio signal processed through the filter function may be optimized and output through the speaker 440. The audio signal may be processed by a different filter for each audio object and then output.

The audio signal processing apparatus may acquire the location information of the speaker 440 in order to determine a parameter of the filter function. The location information of the speaker 440 may be acquired in real time or may be changed and acquired when movement of the speaker 440 is sensed. Whenever a location of the speaker 440 changes, the apparatus may determine a parameter of the filter function, process an audio signal including the determined parameter using the filter function, and then output the processed audio signal.

The location information of the speaker 440 may include a coordinate value having a listening location as an origin (i.e., Cartesian coordinates) or include angle information and distance information of the speaker 440 that are based on the location of the listener 420 (i.e., polar coordinates). For example, the location information of the speaker 440 may include information regarding distances to speakers and information regarding angles between a direction of the listener 420 and the speakers on the basis of the location of the listener 420. When the location information of the speaker 440 is a coordinate value, the coordinate value may be converted into the above-described distance information and angle information with respect to the location of the listener 420. For example, when the coordinate value of the speaker 440 is $(x_R, y_R)$, the location information of the speaker 440 may be converted into an angle value of $\theta_R=\pi/2-\tan^{-1}(y_R/x_R)$ and a distance value of $r_R=y_R/\cos\theta$.

The audio signal processing apparatus may find parameters for correcting the filter function and correct the filter function using the parameters on the basis of the location information of the speaker 440.

A parameter $\text{Filter}_{low}(F_c(\theta_R), G_L(\theta_R))$ of the filter function for amplifying a low-frequency band audio signal according to an exemplary embodiment may be acquired on the basis of the location information of the speaker 440 using Equation 1 below. In Equation 1, $A_F$, $B_F$, A, and B are constant values.

$$F_C(\theta_R)=A_F r_R \sin(\theta_R)+B_F$$

$$G(\theta_R)=A r_R \sin(\theta_R)+B \qquad \text{[Equation 1]}$$

Fc may correspond to the above-described cut-off frequency, and G may correspond to the gain value. Fc and G may be determined on the basis of the linear distance between the speaker and a central axis 430 centered on the location of the listener 420. $A_F$ and $B_F$ may be determined depending on a minimum value and a maximum value of Fc. $A_F$ may be determined as a negative value so that Fc may be determined inversely proportional to $r_R \sin(\theta_R)$, which is the linear distance between the central axis 430 and the speaker. In addition, A and B may be determined depending on a minimum value and a maximum value of G, and A may be determined as a positive value so that G may be determined proportional to $r_R \sin(\theta_R)$.

Furthermore, a gain value and a delay time may be determined on the basis of the location of the multimedia device 410 so that the audio signal is output. The gain value and the delay time may be determined so that the audio signal output from the speaker 440 may seem as though the audio signal is output at the location of the multimedia device 410. The gain value may be determined depending on a distance $r_R$ between the location of the listener 420 and the speaker, for example, as in Equation 2 below.

$$G_t = 10^{G_{db}/20},\ G_{db} = 20 * \log_{10}\left(\frac{r_R}{r_C}\right) \quad \text{[Equation 2]}$$

The apparatus may determine a delay time for correcting a phase difference in the audio signal output from the speaker. When the speaker is moved, the distance between the speaker and the listener may change, thus resulting in a phase difference of a sound output through the speaker.

The apparatus may determine the delay time according to the distance $r_R$ between the location of the listener 420 and the speaker. For example, the delay time may be determined as a difference between times taken for a sound to reach the location of the listener from speakers, as in Equation 3. In Equation 3, 340 m/s refers to the speed of sound, and the delay time may be determined differently depending on an ambient environment in which the sound is transferred. For example, because the speed of sound varies depending on a temperature of air through which the sound is transferred, the delay time may be determined differently depending on the air temperature.

The delay time is not limited by Equation 3 and may be determined in various ways depending on the distance between the listener and the speaker.

$$D_t = (r_C - r_R)/340(m/s) \quad \text{[Equation 3]}$$

The gain value and the delay time that are determined according to Equations 2 and 3 may be applied to the audio signal that may be output through the speaker 440.

The filter function, the gain, and the delay time may be applied to the audio signal that may be output through the speaker 440, as in Equation 4 below.

$$\text{Low_Sig}(t, r_R(m), \theta_R) = [\text{Filter}_{low}(F_C(\theta_R), G(\theta_R)) \otimes (G_t * \text{Input}(t - D_t)] \quad \text{[Equation 4]}$$

G, which is the gain value, may be applied to an audio signal of the frequency section selected on the basis of Fc, and also a gain $G_t$ and a delay time $D_t$ may be applied to the audio signal that may be output through the speaker 440.

The audio signal processing apparatus according to an exemplary embodiment may be inside the multimedia device 410 that processes an image signal corresponding to the audio signal or may be the multimedia device 410. However, embodiments of the present disclosure are not limited thereto. The audio signal processing apparatus may include various types of apparatuses that are connected to the speaker 440 that outputs the audio signal by wire or wirelessly.

When speakers have different heights, the audio signal may be processed in the same method as described above on the basis of location information of the speakers. When the heights of the speakers are different, distances between the listener and the speakers may be different. Accordingly, on the basis of information regarding the distances between the listener and the speakers, the apparatus may determine the above-described delay time and gain value, and may process the audio signal.

Figure 5:
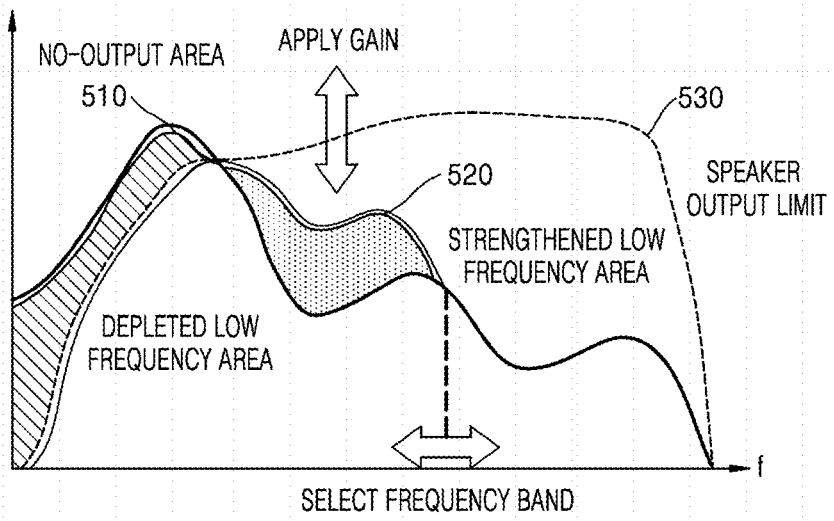
FIG. 5 is a graph showing an example of amplifying an audio signal according to a frequency band according to an exemplary embodiment.

FIG. 5 is a view showing an example of amplifying an audio signal according to a frequency band according to an exemplary embodiment.

In FIG. 5, an audio signal in a frequency domain is shown. The apparatus may acquire an audio spectrum including the magnitude of the audio signal for each frequency by performing frequency transformation on a time-domain audio signal. For example, the apparatus may perform frequency transformation on a time-domain audio signal that belongs to one frame of an audio signal. The magnitude of the audio signal for each frequency may be expressed in decibels (dBs) in the audio spectrum. However, embodiments of the present disclosure are not limited thereto. The magnitude of the audio signal for each frequency may be expressed in various units. The magnitude of the audio signal for each frequency included in the audio spectrum may refer to power, a norm value, intensity, an amplitude, etc.

Due to a speaker output limit 530, a certain frequency band area 510 of the audio signal may not be output through the speaker. Due to the speaker output limit 530, audio signals of some low-frequency bands may not be output at the same level as an input audio signal.

The apparatus according to an exemplary embodiment may amplify a low-frequency band audio signal by applying a gain equal to energy $E_{lack}$ of an audio signal that is not output due to the speaker output limit 530. Energy $E_{reinforcement}$ of the amplified audio signal may be similar or equal to the energy $E_{lack}$ of the audio signal that is not output. The apparatus may supplement the audio signal that is not output due to the speaker output limit 530 by amplifying an audio signal in an area adjacent to an area in which the audio signal 510 is not output.

Energy value of audio signals having frequencies N to M may be determined, for example, using Equation 5. X(m) is a frequency domain audio signal. The above energy values $E_{reinforcement}$ and $E_{lack}$ may be acquired using Equation 5 below.

$$E_{band(N,M)} = \frac{1}{N - M + 1} \sum_{m=M}^{N} |X[m]|^2 \quad \text{[Equation 5]}$$

In addition, when amplifying a low-frequency band audio signal, the apparatus may select a frequency band in which the effect of the amplification of the audio signal may be optimized according to the speaker location information, and may amplify an audio signal of the selected section. A gain that may be applied to the audio signal may be further determined in consideration of the speaker location information. For example, as the speaker moves away from the front of the listener 420, a larger gain may be applied. A gain value that may be applied to the audio signal may be determined on the basis of $E_{lack}$, the speaker location information, the speaker output limit 530, or the like which have been described above.

Figure 6:
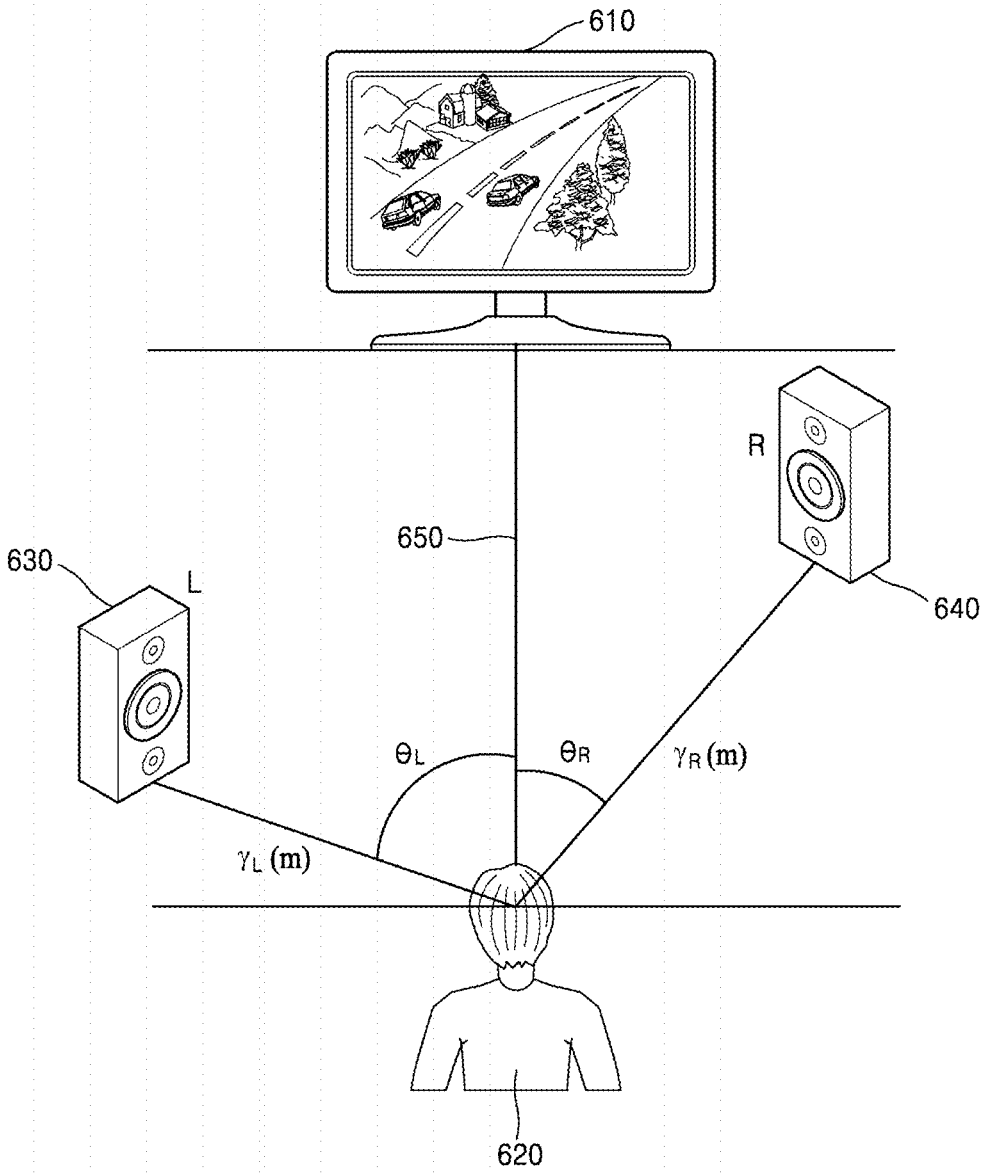
FIG. 6 is a view showing an exemplary placement of a plurality of speakers according to an exemplary embodiment.

FIG. 6 is a view showing an example of placement of a plurality of speakers according to an exemplary embodiment.

Referring to FIG. 6, location information of a plurality of speakers 630 and 640 may be acquired with respect to a location of a listener 620. A multimedia device 610 may be located in front of the location of the listener 620. However, a location of the multimedia device 610 shown in FIG. 6 is merely an example, and the multimedia device 610 may be located in another direction.

An audio signal processing apparatus may have a filter function for amplifying a low-frequency band audio signal on the basis of the speaker location information. The filter function may be provided for each channel of the audio signal. For example, when audio signals are output through left and right speakers, the filter function may be provided for each audio signal that may be output through the left and right speakers. The filter function may be applied according to current locations of the plurality of speakers 630 and 640. An audio signal may be processed for each audio object by the filter function, and then the processed audio signal may be output. The audio signal processing apparatus may acquire the location information of the plurality of speakers 630 and 640 in order to determine a parameter of the filter function.

A sound image of the audio signal may be localized at a different location for each audio object. For example, a sound image may be localized on the multimedia device 610 in which an image signal corresponding to the audio signal is displayed. There may be a sound image for each audio object, and the filter function may be applied to an audio signal for the sound image in order to improve sound quality. A different filter function for each channel may be applied to the audio signal. Since the filter function may be corrected according to the speaker location information, the filter function may be corrected without considering a location at which the sound image is localized.

The audio signal processing apparatus may acquire the location information of the speakers 630 and 640 in order to determine a parameter for correcting the filter function. The location information of the speakers 630 and 640 may be acquired in real time or may be changed and acquired when a movement of one or more of the speakers is sensed. Whenever a location of a speaker changes, the apparatus may correct the filter function and may process the audio signal with the corrected filter function and then output the processed audio signal.

The location information of the speakers 630 and 640 may include a coordinate value having a location of the listener 620 as an origin (i.e., Cartesian coordinates) or include angle information and distance information of the speakers that are based on the location of the listener 620 (i.e., polar coordinates). For example, on the basis of the location of the listener 620, the location information of the speakers 630 and 640 may include information regarding distances to speakers and information regarding angles between a direction of the listener 620 and the speakers. When the location information of each of the speakers 630 and 640 is a coordinate value, the coordinate value may be converted into the above-described distance information and angle information with respect to the location of the listener 620. For example, when the Cartesian coordinates for a speaker is (x, y), location information of the speaker may be converted into an angle value of $\theta=\pi/2-\tan^{-1}(y/x)$ and a distance value of $r=y/\cos\theta$ in the polar coordinate system. Angle information of the speaker may be determined on the basis of a central axis 650 connecting the listener 620 and the multimedia device 610.

The audio signal processing apparatus may find parameters for correcting the filter function and correct the filter function using the parameters on the basis of the location information of the speaker 440.

A parameter $\text{Filter}_{low}(F_c(\theta_R), G_L(\theta_R))$ or $\text{Filter}_{low}(F_c(\theta_L), G_L(\theta_L))$ of the filter function for amplifying a low-frequency band audio signal according to an exemplary embodiment may be acquired on the basis of the location information of the speakers 630 and 640 using the above Equation 1.

Furthermore, on the basis of the location of the multimedia device 610, a gain value and a delay time may be determined so that the audio signals output from the plurality of speakers 630 and 640 may seem as though the audio signal is output at the location of the multimedia device 610. The gain value and the delay time may be determined using the above Equations 2 and 3.

In addition, because the audio signals are output in different directions through the plurality of speakers 630 and 640, a panning gain for correcting the directions of the output audios signals may be further applied to the audio signals. When a speaker is moved, the direction of sound output through the speaker may be panned with respect to the listener. Thus, the panning gain may be determined on the basis of a degree of panning output through the speaker. The apparatus may determine a panning gain that may be determined according to an angle $\theta_L$ or $\theta_R$ at which the speaker is panned with respect to the location of the listener 620. The panning gain may be determined for each speaker. For example, the panning gain may be determined as in Equation 6 below.

$$G_{P_L} = \cos\left(\frac{\pi|\theta_L|}{2(|\theta_L| + |\theta_R|)}\right), \quad G_{P_R} = \sin\left(\frac{\pi|\theta_L|}{2(|\theta_R| + |\theta_R|)}\right) \qquad \text{[Equation 6]}$$

The filter function, the gain, and the delay time may be applied to the audio signals that may be output through the plurality of speakers 630 and 640, as in Equation 7 below.

$$\text{Low_Sig}_L(t, r_L(m), \theta_L) = G_{P_L} * [\text{Filter}_{low}(F_C(\theta_L), (G_L(\theta_L)) \otimes (G_t * \text{Input}(t - D_t)]$$

$$\text{Low_Sig}_R(t, r_R(m), \theta_R) = G_{P_R} * [\text{Filter}_{low}(F_C(\theta_R), (G_L(\theta_R)) \otimes (G_t * \text{Input}(t - D_t)] \qquad \text{[Equation 7]}$$

A method of amplifying an audio signal according to an energy variation of an audio signal will be described below in more detail with reference to FIGS. 7 and 8.

Figure 7:
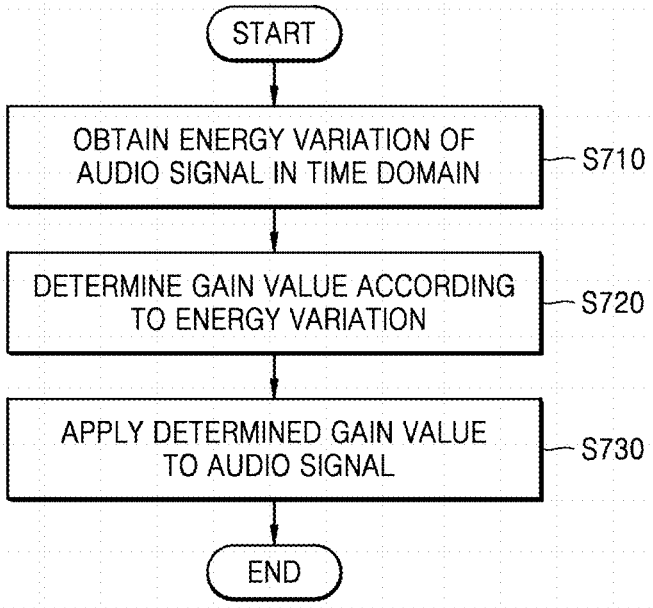
FIG. 7 is a flowchart a method of processing an audio signal according to an energy variation according to an exemplary embodiment.

FIG. 7 is a flowchart showing a method of processing an audio signal according to an energy variation according to an exemplary embodiment.

Referring to FIG. 7, in step S710, an audio signal processing apparatus may obtain an energy variation of an audio signal in a time domain. For example, the apparatus may obtain the energy variation of the audio signal for each frame. An audio signal that may be processed in FIG. 7 may be an audio signal having a low-frequency band amplified according to FIGS. 3-6. However, embodiments of the present disclosure are not limited thereto. The audio signal that may be processed in FIG. 7 may be an audio signal that is processed in various ways or that is not processed.

When an energy variation between frames is set as $E_{diff}(t)$, $E_{diff}(t)$ may be determined as in Equation 8 below.

$$E_{diff}(t)=|E(t)-E(t-1)| \quad \text{[Equation 8]}$$

In step S720, the apparatus may determine a gain value according to the energy variation determined in step S710. In step S730, the apparatus may apply the determined gain value to the audio signal. For example, the gain value may be determined proportional to the energy variation. A gain value G(t) may be determined as in Equation 9 below.

$$G(t)=G(t-1)+E_{diff}(t)\times\text{constant} \quad \text{[Equation 9]}$$

The gain value may be applied to a corresponding audio signal for each frame. As the energy variation increases, the gain value applied to the audio signal may increase, thus further strengthening a sense of punch. Compared to a case in which the same gain value is applied to all frames, when different gain values are applied to frames according to the energy variation, a dynamic range of the audio signal may be maintained, and also the sense of punch may be further strengthened.

Accordingly, according to an exemplary embodiment, a large gain value may be applied to a transient section of an audio signal in which energy changes rapidly. In addition, a small gain value may be applied to a sustain section of the audio signal in which energy is constantly maintained. A sense of punch may be further strengthened by applying a larger gain value to an audio signal in the transient section in which the energy variation is large.

Figure 8:
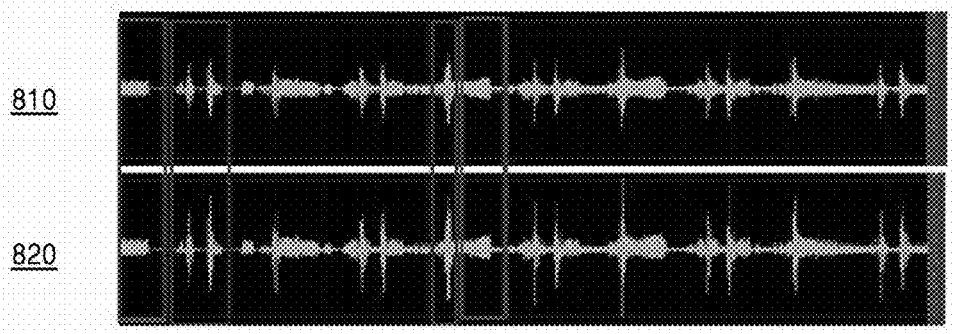
FIG. 8 is a view showing an example in which an audio signal is processed according to an energy variation according to an exemplary embodiment.

FIG. 8 is an exemplary view showing an example in which an audio signal is processed according to an energy variation according to an exemplary embodiment.

Referring to FIG. 8, reference number 810 relates to an example of a time domain audio signal before the audio signal is processed according to the energy variation, and reference number 820 relates to an example of a time domain audio signal after the audio signal is processed according to the energy variation.

Compared to the audio signal 810, the audio signal 820 may be amplified more than audio signals in other sections by applying a larger gain value to an audio signal in a section having a larger energy variation. Because a different gain value may be applied to the audio signal depending on the energy variation, a sense of punch of the audio signal may be strengthened.

A method of processing an audio signal on the basis of the magnitude of a non-mono signal will be described below in more detail with reference to FIGS. 9 and 10. The audio signal processing apparatus according to an aspect of an exemplary embodiment may amplify a low-frequency band audio signal on the basis of the magnitude of a non-mono signal, such as a background sound, a sound effect, or the like, that is smaller than that of a mono signal. Accordingly, clipping or discontinuous-signal distortion that occurs due to amplification of a low-frequency band audio signal may be minimized.

Figure 9:
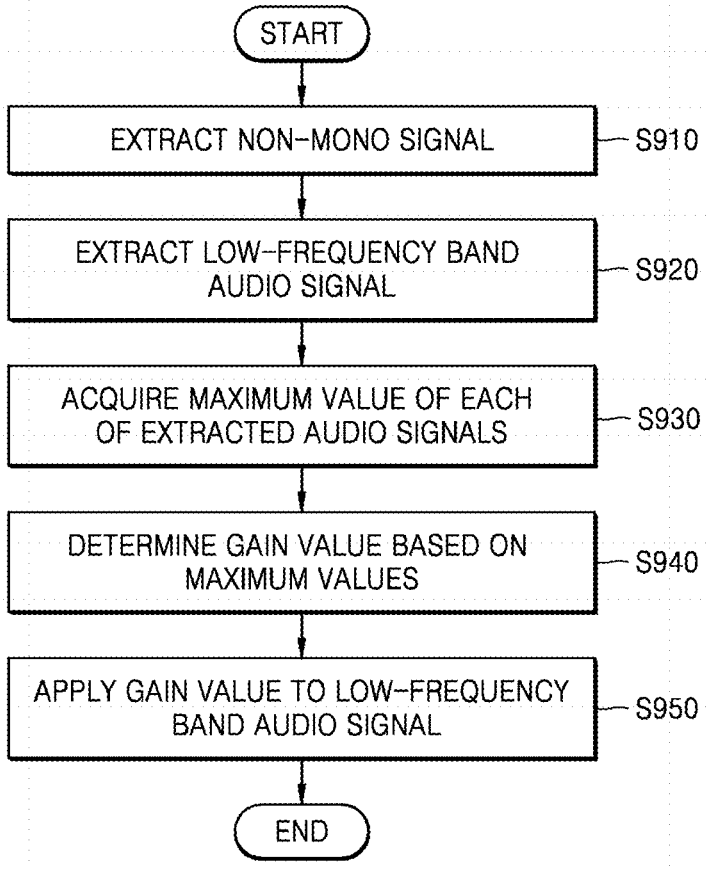
FIG. 9 is a flowchart a method of processing an audio signal on the basis of the magnitude of a non-mono signal according to an exemplary embodiment.

FIG. 9 is a flowchart showing a method of processing an audio signal on the basis of the magnitude of a non-mono signal according to an exemplary embodiment.

In step S910 of FIG. 9, an apparatus may extract a non-mono signal from an audio signal. For example, the apparatus may extract the non-mono signal from the audio signal for each frame and may process the audio signal. The non-mono signal may include a signal, such as a background sound, a sound effect, or the like, that may be output as a stereo signal. The non-mono signal may include an audio signal having a smaller magnitude than the mono signal.

In step S920, the apparatus may extract a low-frequency band audio signal from the audio signal. The apparatus may select a frequency band according to the above-described speaker location information and may acquire an audio signal corresponding to the selected frequency band. However, embodiments of the present disclosure are not limited thereto. The apparatus may extract the low-frequency band audio signal in various ways.

In step S930, the apparatus may acquire a maximum value of the low-frequency band audio signal and the non-mono signal that are extracted in steps S910 and S920. In other words, the apparatus may acquire the maximum value of the non-mono signal and the maximum value of the low-frequency band audio signal for each frame. The apparatus may modify the maximum value using a method such as one-pole estimation so that a gain value may change rapidly according to the maximum value. For example, the apparatus may modify a maximum value X(t) as in Equation 10 below. Y(t−1) is a modified maximum value of a previous frame, Y(t) and X(t) are a maximum value after the modification and a maximum value before the modification, respectively. The constant value a presented in Equation 10 is merely an example, and may be set to a different value.

$$Y(t)=a\times Y(t-1)+(1-a)\times x(t), a=0.9995 \quad \text{[Equation 10]}$$

In step S940, the apparatus may determine a gain value on the basis of the maximum values acquired in step S930. In step S950, the apparatus may apply the determined gain value to the low-frequency band audio signal. For example, the gain value may be determined using Equation 11. $Max_N$ is a modified maximum value that is acquired from the non-mono audio signal, and $Max_L$ is a modified maximum value that is acquired from the low-frequency band audio signal.

$$G_{adap}=Max_N/Max_k \quad \text{[Equation 11]}$$

When a value of $G_{adap}$ is less than 1, the value of $G_{adap}$ may be determined as 1. The maximum value and the gain value determined using Equation 10 and Equation 11 are merely examples, and embodiments of the present disclosure are not limited thereto. The maximum value and the gain value may be acquired in various ways.

Figure 10:
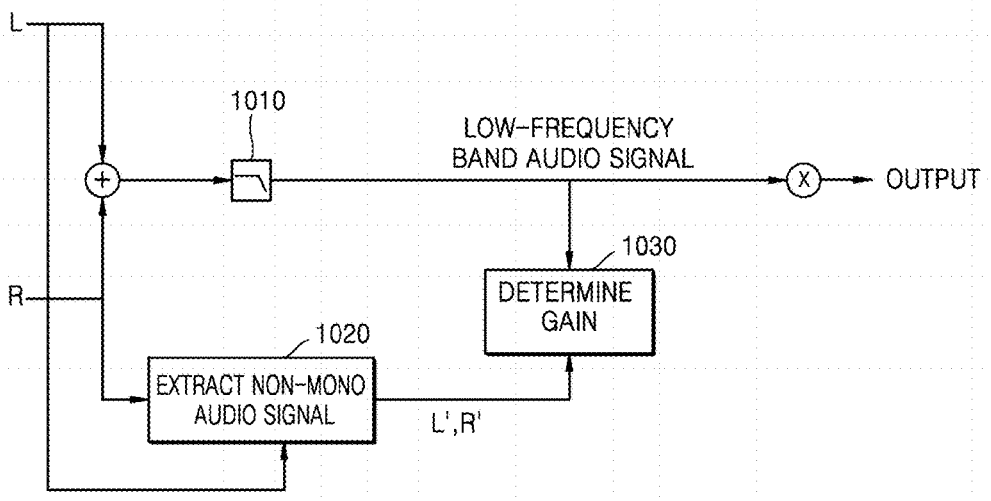
FIG. 10 is a block diagram showing a method of processing an audio signal on the basis of the magnitude of a non-mono signal according to an exemplary embodiment.

FIG. 10 is a block diagram showing a method of processing an audio signal on the basis of the magnitude of a non-mono signal according to an exemplary embodiment. A method of processing an audio signal, which is shown in FIG. 10, may include extracting a non-mono audio signal (1020) and determining a gain (1030). The method of processing an audio signal which is shown in FIG. 10 may be implemented by the above-described audio signal processing apparatus.

Referring to FIG. 10, in step 1010, a low-frequency band audio signal may be extracted from an audio signal. The low-frequency band audio signal may be extracted by a low pass filter.

In addition, in step 1020, a non-mono audio signal may be extracted from the audio signal. For example, the non-mono audio signal may be extracted on the basis of configuration information of the audio signal.

In step 1030, the gain value $G_{adap}$ may be determined on the basis of maximum values of the non-mono audio signal and the low-frequency band audio signal. The gain value $G_{adap}$ may be determined on the basis of a ratio between the maximum values of the non-mono audio signal and the low-frequency band audio signal. Accordingly, the low-frequency band audio signal to which the gain value $G_{adap}$ is applied may be amplified to the maximum value of the non-mono audio signal or less.

The low-frequency band audio signal may be amplified and output by applying the gain value $G_{adap}$ to the low-frequency band audio signal.

Figure 11:
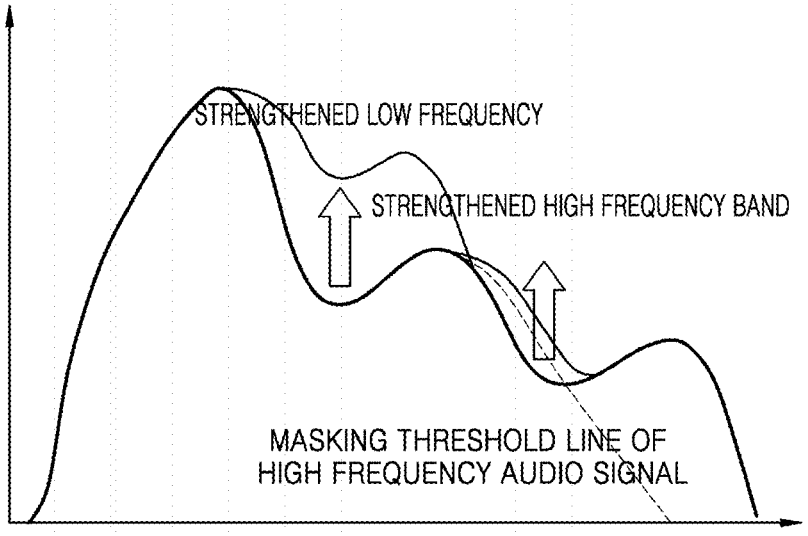
FIG. 11 is a view showing an example of amplifying an audio signal in masked medium-to-high frequency bands according to an exemplary embodiment.

FIG. 11 is a view showing an example of amplifying an audio signal in masked medium-to-high frequency bands according to an exemplary embodiment.

Referring to FIG. 11, because a low-frequency band audio signal is strengthened, masking may occur in a high-frequency band audio signal. A masking threshold may be acquired on the basis of a peak point of a frequency domain audio signal. Masking may occur in an audio signal that is equal to or less than the masking threshold.

An audio signal including high-priority information may be amplified to prevent the high-frequency band audio from including the high-priority information, such as a vocal, a voice, or the like, and thus being masked. Accordingly, the apparatus may amplify the high-frequency band audio signal to the masking threshold or more as the low-frequency band audio signal is amplified to minimize masking for the high-frequency band audio signal including the high-priority information.

Figure 12:
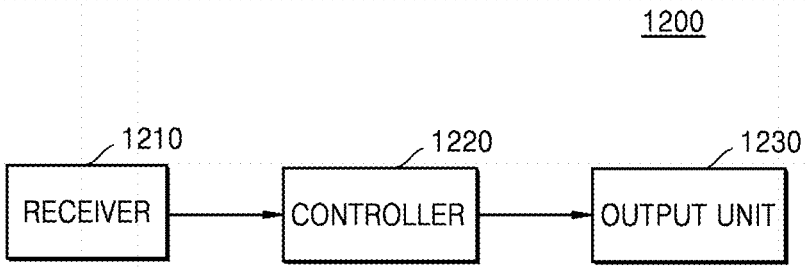
FIG. 12 is a block diagram showing an audio signal processing apparatus according to an exemplary embodiment.

FIG. 12 is a block diagram showing an audio signal processing apparatus according to an exemplary embodiment.

An audio signal processing apparatus 1200 according to an exemplary embodiment may be a terminal device that may be used by a user. For example, the audio signal processing apparatus 1200 may be a smart television (TV), a ultra high definition (UHD) TV, a monitor, a personal computer (PC), a notebook computer, a mobile phone, a tablet PC, a navigation terminal, a smartphone, a PDA, a portable multimedia player (PMP), or a digital broadcast receiver. However, embodiments of the present disclosure are not limited thereto. The apparatus 1200 may include various types of devices.

Referring to FIG. 12, the apparatus 1200 may include a receiver 1210, a controller 1220, and an output unit 1230.

The receiver 1210 may acquire an audio signal and information regarding a location of a speaker which will output the audio signal. The receiver 1210 may periodically acquire the speaker location information. For example, the speaker location information may be acquired from a sensor configured to sense a location of a speaker which is included in the speaker, or an external device configured to sense the location of the speaker. However, embodiments of the present invention are not limited thereto. The receiver 1210 may acquire the speaker location information in various ways.

The controller 1220 may select a frequency band on the basis of the speaker location information acquired by the receiver 1210 and may apply a gain value to an audio signal corresponding to the selected frequency band to amplify the audio signal. The controller 1220 may select a frequency band whenever the speaker location information is changed and then may amplify an audio signal of the selected frequency band.

In addition, the controller 1220 may analyze an energy variation of an audio signal in a time domain, determine a gain value according to the energy variation, and apply the determined gain value to the audio signal, thus strengthening a sense of punch of the audio signal. The controller 1220 may analyze the energy variation at predetermined intervals and amplify the audio signal.

In addition, the controller 1220 may extract a non-mono audio signal and a low-frequency band audio signal from the audio signal, acquire a maximum value of the extracted audio signal, and determine a gain value on the basis of the maximum value. The controller 1220 may amplify the audio signal by applying a gain value determined according to a ratio between a maximum value of the non-mono audio signal and the maximum value of the low-frequency band audio signal to the audio signal, thus amplifying the audio signal while minimizing clipping. The controller 1220 may determine the gain value at predetermined intervals to amplify the audio signal.

The output unit 1230 may output the audio signal processed by the controller 1220. The output unit 1230 may output the audio signal to the speaker.

According to an aspect of an exemplary embodiment, a high-quality audio signal may be provided to a listener by processing the audio signal according to location information of a speaker that is located at any position.

The method according to some embodiments may be implemented as program instructions executable by a variety of computers and recorded on a computer-readable medium. The computer-readable medium may also include a program instruction, a data file, a data structure, or combinations thereof. The program instruction recorded in the medium may be designed and configured specially for the present invention or can be publicly known and available to those skilled in the field of computer software. Examples of the computer-readable medium include a magnetic medium, such as a hard disk, a floppy disk, and a magnetic tape, an optical medium, such as a compact disc read-only memory (CD-ROM), a digital versatile disc (DVD), or the like, a magneto-optical medium such as a floptical disk, and a hardware device specially configured to store and execute program instructions, for example, read-only memory (ROM), random access memory (RAM), flash memory, etc. Examples of the program instruction include machine codes generated by, for example, a compiler, as well as high-level language codes executable by a computer using an interpreter.

The above description is primarily focused on the novel features of various exemplary embodiments. However, it should be understood by those skilled in the art that various deletions, substitutions, and changes in form and details of the above-described apparatus and method may be made therein without departing from the spirit and scope of the present disclosure. All changes or modifications within the appended claims and their equivalents should be construed as being included in the scope of the present disclosure.

What is claimed is:

1. A method of processing an audio signal, the method comprising:

acquiring location information and performance information of a speaker configured to output the audio signal;

selecting a frequency band based on the location information;

determining a section of the audio signal to be strengthened from the selected frequency band with respect to the audio signal based on the performance information; and applying a gain value to the determined section.

2. The method of claim 1, wherein the selecting the frequency band comprises:

determining a central axis based on a location of a listener; and selecting the frequency band based on a linear distance between the speaker and the central axis.

3. The method of claim 1, wherein the applying the gain value comprises:

determining a central axis based on a location of a listener; and determining the gain value based on a distance between the speaker and the central axis; and applying the determined gain value to the determined section.

4. The method of claim 1, further comprising:

determining a parameter based on the location information; and processing the audio signal using the determined parameter, wherein the parameter comprises at least one of a gain for correcting a sound level of a sound image of the audio signal based on the location information of the speaker, and a delay time for correcting a phase difference of the sound image of the audio signal based on the location information of the speaker.

5. The method of claim 4, wherein, when a plurality of speakers are provided, the parameter further includes a panning gain for correcting a direction of a sound image of the audio signal.

6. The method of claim 1, further comprising:

obtaining an energy variation of the audio signal between frames in a time domain;

determining a gain value of a frame according to the energy variation; and applying the determined gain value to a portion of the audio signal corresponding to the frame.

7. The method of claim 1, further comprising:

detecting a section in which masking has occurred based on the section to which the gain value is applied; and applying the gain value to the detected section of the audio signal so that a portion of the audio signal corresponding to the detected section has a value greater than or equal to a masking threshold.

8. The method of claim 1, wherein the applying the gain value comprises:

extracting a non-mono signal from the audio signal;

determining the gain value based on a maximum value of the non-mono signal; and applying the determined gain value to the audio signal.

9. An audio signal processing apparatus comprising:

a receiver configured to acquire location information and performance information of a speaker configured to output an audio signal;

a controller configured to select a frequency band based on the location information, determine a section of the audio signal to be strengthened from the selected frequency band with respect to the audio signal based on the performance information, and apply a gain value to the determined section; and an output unit configured to output the audio signal having the gain value applied to the determined section by the controller.

10. The audio signal processing apparatus of claim 9, wherein the controller is further configured to determine a central axis based on a location of a listener and select the frequency band based on a linear distance between the speaker and the central axis.

11. The audio signal processing apparatus of claim 9, wherein the controller is further configured to determine a central axis based on a location of a listener, determine the gain value based on a distance between the speaker and the central axis, and apply the determined gain value to the determined section.

12. The audio signal processing apparatus of claim 9, wherein the controller is further configured to determine a parameter based on the location information and process the audio signal using the determined parameter, and wherein the parameter comprises at least one of a gain for correcting a sound level of a sound image of the audio signal based on the location information of the speaker, and a delay time for correcting a phase difference of the sound image of the audio signal based on the location information of the speaker.

13. The audio signal processing apparatus of claim 9, wherein the controller is further configured to obtain an energy variation of the audio signal between frames in a time domain, determine a gain value of a frame according to the energy variation, and apply the determined gain value to a portion of the audio signal corresponding to the frame.

14. The audio signal processing apparatus of claim 9, wherein the controller is further configured to detect a section in which masking has occurred based on the section to which the gain value is applied, and apply the gain value to the detected section of the audio signal so that the detected section of the audio signal has a value greater than or equal to a masking threshold.

15. The audio signal processing apparatus of claim 9, wherein the controller is configured to extract a non-mono signal from the audio signal, determine the gain value based on a maximum value of the non-mono signal, and apply the determined gain value to the audio signal.

16. A non-transitory computer-readable recording medium storing instructions which, when executed by a processor, cause the processor to perform method of processing an audio signal, the method comprising:

acquiring location information and performance information of a speaker configured to output the audio signal;

selecting a frequency band based on the location information;

determining a section of the audio signal to be strengthened from the selected frequency band with respect to the audio signal based on the performance information; and applying a gain value to the determined section.

* * * * *